US009272228B2

(12) United States Patent
Eck et al.

(10) Patent No.: US 9,272,228 B2
(45) Date of Patent: Mar. 1, 2016

(54) FULL-DUPLEX, WIRELESS CONTROL SYSTEM FOR INTERACTIVE COSTUMED CHARACTERS

(71) Applicant: DISNEY ENTERPRISES, INC., Burbank, CA (US)

(72) Inventors: Timothy J. Eck, Winter Garden, FL (US); Holger Irmler, Los Angeles, CA (US); Asa Kalama, Glendale, CA (US); James Robertson, Los Angeles, CA (US); Christopher Cameron Stuart, Orlando, FL (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 23 days.

(21) Appl. No.: 14/320,879

(22) Filed: Jul. 1, 2014

(65) Prior Publication Data

US 2016/0001193 A1 Jan. 7, 2016

(51) Int. Cl.

*A63H 33/00* (2006.01)
*A63J 7/00* (2006.01)
*A63G 31/00* (2006.01)

(52) U.S. Cl.

CPC *A63J 7/005* (2013.01); *A63G 31/00* (2013.01)

(58) Field of Classification Search

USPC ..... 446/26, 27, 28, 175, 330, 391, 392; 2/69, 209.13

See application file for complete search history.

(56) References Cited

U.S. PATENT DOCUMENTS 4,660,033 A * 4/1987 Brandt ..... G11B 33/06 2/69
4,683,588 A * 7/1987 Goldberg ..... A41G 7/02 2/410
6,500,041 B1 * 12/2002 Crome, Jr. ..... A42B 1/004 2/195.1
8,371,893 B2 * 2/2013 Eck ..... A63J 7/005 446/175
8,727,898 B2 * 5/2014 Kanemaru ..... A63J 7/005 446/26
8,758,074 B2 * 6/2014 Dilworth ..... A63H 37/00 446/26
8,801,488 B2 * 8/2014 Irmler ..... A63G 31/00 2/171
2005/0159072 A1 * 7/2005 Brown ..... A41D 1/002 446/26
2005/0287911 A1 * 12/2005 Schulze ..... A63H 3/14 446/297
2007/0037520 A1 * 2/2007 Warren ..... A42B 1/245 455/66.1
2008/0287033 A1 * 11/2008 Steinberg ..... A63H 3/28 446/297
2009/0203286 A1 * 8/2009 Murayama ..... A63H 3/28 446/27
2014/0011428 A1 * 1/2014 Barthold ..... A63H 3/003 446/268

* cited by examiner

*Primary Examiner* — Kurt Fernstrom
(74) *Attorney, Agent, or Firm* — Marsh Fischmann & Breyfogle LLP; Kent A. Lembke

(57) ABSTRACT

A control system for interactively operating a show control system (audio plus data) provided in a walk-around character costume. The system includes an interactive controller wearable with the walk-around character costume. The system includes an audio base station and a host controller communicatively linked to the audio base station. The interactive controller and the audio base station communicate via a wireless communications link. The control system includes a speaker controlled by the interactive controller, and the host controller transmits data over the wireless communications link via the audio base station including commands to play an audio file and an animation file, stored in memory accessible by the interactive controller, with the speaker. The control system includes microphones, linked to the interactive controller, capturing sounds near the walk-around character costume, and the interactive controller transmits the captured sounds over the communications link to the host controller via the audio base station.

15 Claims, 4 Drawing Sheets

WEARABLE SYSTEM (COSTUME ASSEMBLY) DIAGRAM

FULL-DUPLEX, WIRELESS CONTROL SYSTEM FOR INTERACTIVE COSTUMED CHARACTERS

BACKGROUND

1. Field of the Description

The present invention relates, in general, to walk-around costumed characters and control over audio output (e.g., a character may sing or talk when its systems are selectively operated) on such walk-around characters, and, more particularly, to methods and systems for implementing remote triggering or control over a walk-around character costume (i.e., its audio and/or animating components) to selectively and more effectively trigger audio playback of pre-recorded and stored audio clips in an asynchronous manner (and, in some cases, to concurrently or separately trigger operation of mechanical and/or electrical components that cause the costume components to move or to be animated).

2. Relevant Background

Walk-around or costumed characters are used to entertain and interact with visitors of many facilities including theme or amusement parks such as during meet-and-greet shows and theatrical shows at such facilities. A walk-around character may be provided by an operator or performer wearing a costume including a head that covers the performer's face. The costume head is mounted to or supported on a headband worn by the performer or head-worn suspension or hat suspension may be used to support the costume head. In the head and/or costume, equipment including sound equipment (e.g., a speaker for playing pre-recorded audio) and robotics are provided so that a walk-around character can "speak" with visitors by playing back pre-recorded lines of conversation that may be scripted in advance, by playing live voice from backstage performers, and/or by outputting the in-costume performer's voice to provide a meetable character or "hero" that can also, if desired, be animated to move their eyes, mouth, and other features on their head or face while they talk and interact with the visitors.

In many applications, the walk-around character is representing a character from a movie, a video game, a cartoon, or the like. The visitors expect that character to have a particular or a single voice, e.g., the voice used in the movie, and the quality and believability of this voice-over content often cannot be recreated electronically, e.g., with a voice changer. As a result, the performer cannot use their own voice when they meet and talk with visitors, and, instead, scripted lines and dialog (i.e., audio content) typically are recorded by pre-approved voice talent for each of the walk-around characters to provide the expected voices. Onboard audio or sound equipment in the worn costume is provided to store the audio clips, to allow their ready retrieval, and to provide speakers for local output of the audio content to nearby visitors when the audio equipment is controlled or triggered to playback these lines at appropriate times. The character's head may simultaneously be animated such as by operating robotics to provide mouth movement and eye blinks synchronized to the audio playback.

To allow each walk-around character to speak to visitors, there has to be an effective way to trigger the audio that cannot be detected by the nearby visitors. The triggering mechanism should not be audible to the visitor. In some implementations, control is provided to the performer within the costume using finger paddles that the performer can operate to lip sync the character mouth to the pre-recorded audio track being played back to the visitor. Use of finger paddles by the actor or puppeteer wearing the costume, though, may be apparent to the visitors, which can detract from the illusion or desired effect.

Other implementations use a backstage operator who has control over the audio and animation by selectively sending wireless control signals to the costume's sound and animation system. However, it has proven very difficult for this backstage operator to control, in real time, the simultaneous audio playback and animation of the costume's features in a manner that appears interactive with visitors and works for a real-time meet and greet with these visitors. Hence, many applications have been limited to playback of predetermined "canned" animation of the costume's features with audio playback synchronized with such animation, e.g., in a show or a parade audio or a soundtrack and/or dialog is synchronized with animation by robotics via a Society of Motion Pictures and Television Engineers (SMPTE) time code or the like.

There remains a need for effective ways to control walk-around character equipment such as to control an audio playback and animation of the character's mouth. Preferably, the controls would not be audible and would not be detectable by an observer. Also, it would be useful for such controls to be in adaptive in real time to provide a walk-around costumed character that interacts in a conversational manner with visitors in a meet-and-greet or similar interactive experience.

SUMMARY

The following description provides a control assembly or system for use with walk-around costumes or costumed characters with enhanced control functionality to facilitate real-time, interactive, and remote triggering or control to silently and non-visibly trigger audio, animation, and/or special effects by operation of onboard (or "on-costume") components. The inventors recognized that a technical need existed to devise hardware and/or software to control and playback asynchronous audio (e.g., rather than a canned playback of an entire scripted show) and/or to provide animation cues.

The control systems described herein address this and other needs. For example, the control systems may be configured to provide a bi-directional (full-duplex) audio intercom system to enable backstage or remote operators and in-costume performers to communicate in a discrete manner to avoid observer detection. The control system may be implemented to provide localized audio peripherals (also called audio enhancements or modular additions, herein) in the costume, such as in the costume or character head, including speakers, microphones, in-ear monitors, and the like, which were not provided in prior articulated character heads.

The character control assembly can allow the operator (or performer) wearing a walk-around costume to trigger audio playback and to trigger animation of the character's mouth (or to trigger other character-based operation or special effects) without finger paddles or an additional backstage operator while some embodiments utilize and provide communications with a backstage operator. When a "trigger" or triggering action is sensed by the control assembly, the response often will be to navigate within a dialog tree to initiate a particular set of pre-recorded audio to be played back via the sound system provided within the walk-around costume (e.g., a speaker within the character head may greet a visitor with "Hello" or, if later in the dialog tree or in a different scene within the dialog tree, with "Goodbye"). In some embodiments, the set of pre-recorded audio selected is context-specific and is selected by a context modulator based on input from an operator (e.g., a host, a photographer, or the like). For example, an operator of a context input device, such as a wireless communication device with a touchscreen providing an iconographic listing of available contexts, may observe a characteristic about a visitor or participant of a room/set in which the walk-around costumed character is performing and respond by selecting one of a number of context-related icons/input buttons on the input device. The context modulator receives this context input and uses it to retrieve a proper set of pre-recorded clips for a scene/show (e.g., to shift or bias the resulting conversation or interaction toward a particular visitor's characteristics such as a pre-teen girl wearing a princess outfit or a person celebrating their birthday).

More particularly, a control system is provided for selectively operating a sound system provided in a walk-around character costume. The system includes an interactive controller adapted for a performer to wear with the walk-around character costume. The system also includes an audio base station spaced apart from the interactive controller and further includes a host controller communicatively linked to the audio base station. In operation, the interactive controller and the audio base station each includes a wireless communication element operable to provide a full-duplex communications link between the interactive controller and the audio base station.

The control system may include a speaker controlled by the interactive controller, and the host controller transmits data over the full-duplex communications link via the audio base station including commands to play an audio file, stored in memory accessible by the interactive controller, with the speaker. The control system may also include a microphone (or a pair of microphones) linked to the interactive controller. Then, in system operations, the microphone captures sounds proximate to the walk-around character costume, and the interactive controller transmits the captured sounds over the full-duplex communications link to the host controller via the audio base station. Further, in some cases, the audio file is selected by the host controller (or its operator) based on the captured sounds. For example, a person or operator may decipher captured sounds and make a decision (e.g., another system or device is not used to analyze sounds).

In some implementations, the control system includes an audio output device (e.g., ear buds, head phones, or the like wearable by the performer wearing the costume) that operate to output audio perceptible by the performer. During system operations, the host controller generates additional audio content and mixes the additional audio content with the captured sounds and transmits the mixed additional audio content and the captured sounds to the interactive controller over the full-duplex communications link for playback with the audio output device. In some cases, the additional audio content is vocal communications from an operator of the host controller. Further, the system may include costume animation mechanisms (e.g., robotics that make a mouth or eye move in a character head) that are controlled by the interactive controller, and the host controller transmits data over the full-duplex communications link via the audio base station including commands to play an animation file, stored in memory accessible by the interactive controller, to selectively operate the animation mechanisms (e.g., in synchronization with playback of a corresponding audio file).

DETAILED DESCRIPTION

Figure 1:
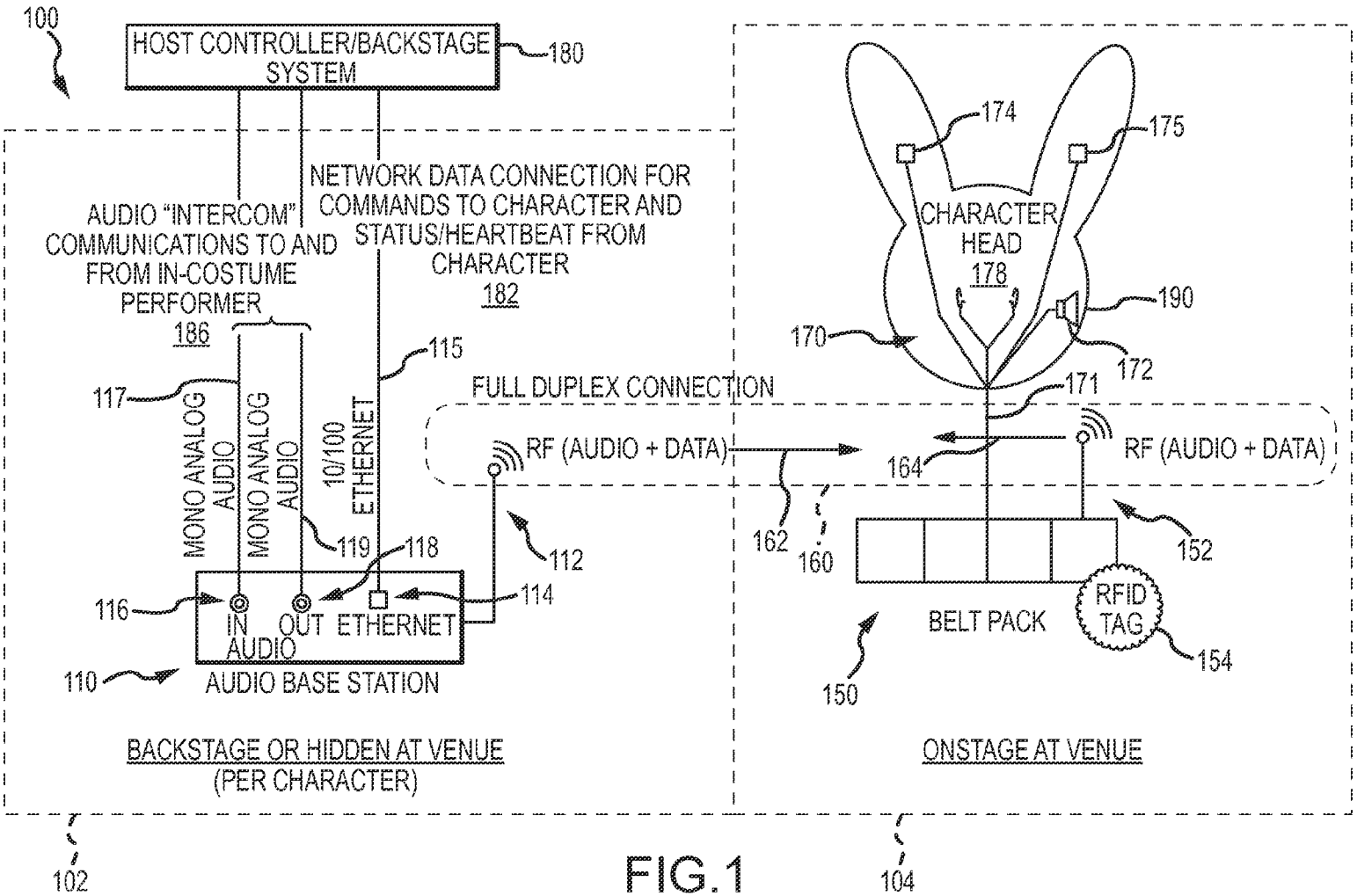
FIG. 1 is a functional block drawing of a control system or assembly adapted for use with a walk-around character costume (e.g., with an articulated or non-articulated head) to facilitate control or navigation of audio playback and/or animation of costume components such as lip and eye movements.

Briefly, the present description is directed toward methods and systems for controlling a walk-around, costume (or costumed character) to allow a remote operator (e.g., an operator of an audio (or control) base station) or remote host to better operate a sound system or special effects/robotics on (or in) the costume to allow the costumed character to interact with visitors or observers.

Each costume control system typically will include two primary components: (1) a wearable interactive audio controller, which is a small and self-contained belt pack device in some embodiments that is concealed under portions of the costume and that can be wirelessly controlled; and (2) an audio base station transceiver, which is positioned a distance or remote from the audio controller and the performer-worn costume (e.g., hidden within the room where the costumed character is performing) and is typically a rack-mounted show control hardware device with audio connectivity (full duplex) with the audio controller and with Ethernet connectivity (e.g., to a host controller/backstage system to be operable by an operator to trigger audio playback (and, in some cases, animation of the costume components) by relaying commands to the character via the full duplex communication link or connection). Additionally, the control system may include modular additions to the character head of the walk-around costume in the form of audio enhancements. These audio enhancements may include one or more speakers, microphones, an audio harness, an audio junction box for use within an articulated character head or other wearable costume appliance, and/or other components that facilitate the wearing or mobile nature of the audio system and its use for full-duplex communications with the audio base station.

Prior to turning to exemplary implementations with reference to the figures, it may be useful to briefly describe the operation of the control system (e.g., its theory or method of operation). The wearable interactive audio controller (or character head audio controller or interactive controller or belt pack controller) is adapted to provide selective and asynchronous playback of pre-recorded audio and animation. In this regard, memory such as a micro-secure digital (SD) card or flash memory, within the interactive controller stores all audio clips and animation show data. Hence, the wireless data connection from the host controller via the audio base station simply operates to transmit or command asynchronous cues to the character or walk-around costume and its interactive controller. In this way, there is no visitor or observer-facing audio content that must be routed through radio frequency (RF) links or other wireless communications to enhance or retain a desired level of show quality and/or reliability.

The wearable interactive controller also is adapted to wirelessly receive and transmit real-time audio and further to wirelessly receive and transmit real-time data to and from a character head (or an electrified costume application) and its components (e.g., a sound system and articulation mechanisms). The communication link or connection is configured as a full-duplex connection to allow receiving of audio and/or data and transmitting audio and/or data to occur concurrently. More specifically, the interactive controller (or human-worn belt pack controller) receives wireless data commands and audio from an external (but proximate) audio base station (ABS) and also transmits audio and data back to the ABS. Therefore, it can be considered a wireless transceiver for data transmission and a full-duplex audio intercom allowing mono audio to travel from the ABS to the belt pack controller (e.g., for output via performer-worn ear buds or the like within the character head portion of the walk-around costume). Mono audio can also travel (without delay or waiting as in half-duplex communication links) from the belt pack controller to the ABS (e.g., for microphone-based surveillance of the environment sounds, such as a person speaking to the costumed character, providing audio to a backstage operator of a host controller via the ABS' Ethernet connection with the host controller).

In practice, the commands to the ABS can come from any "host" (e.g., the host controller can take many forms to implement the control systems described herein) with the ability to send cues or commands. For example, the host or host controller may be: (1) a device with a computerized touch screen operated by a backstage or remote operator; (2) a pre-programmed show controller; (3) a show, story, or game engine controlling an interactive experience between the performer in the walk-around costume and one or more visitors/observers; and (4) a computing device running a terminal program adapted for receiving manual input from a user/operator.

FIG. 1 illustrates a functional block diagram or schematic of a control system 100 of the present description that is useful for providing an interactive wearable character costume (and other similar interactive device applications). As shown, the system 100 includes an audio base station (or ABS) 110 positioned backstage or hidden (as shown with dashed line 102) at a venue where a costumed character is performing/present. The system 100 includes a costume assembly provided onstage at the venue (as shown with dashed line 104). The costume assembly is illustrated as comprising a belt pack controller 150 that is wired or wirelessly linked (as shown with line 171) to a sound system or assembly 170 positioned or provided in a character costume such as in the character head 190 (as shown in FIG. 1).

The system 100 further includes a host controller (or backstage system) 180, which is operable by a host or an operator in some cases to selectively provide cues/commands to the costume assembly via ABS 110 and belt pack controller 150. The host controller 180 is communicatively linked via digital communication line 115 to the ABS 110 at Ethernet connection 114. The digital communication line 115 may provide a network data connection between the host controller 180 and the ABS 110 (and, hence, the belt pack controller 150 of the costume assembly), and this connection is used by the host controller 180 to receive (via ABS 110) status/heartbeat data from the costume assembly (e.g., via operations of the belt pack controller 150) and also to transmit cues or commands (control signals) as shown at 182 to the ABS 110 for relay to the belt pack controller 150.

Significantly, the ABS 110 and belt pack controller 150 each have an audio input/output element (e.g., a transceiver) as shown at 112, 152, and the ABS 110 and belt pack controller 150 with their elements 112, 152 are configured to communicate via a wireless connection 160. The connection 160 is implemented as a full-duplex connection or for full-duplex (or bi-directional) communications. This is shown with arrow 162 indicating the ABS 110 transmitting audio and/or data via an RF signal(s) to the belt pack controller 150 and its input/output element 152 and with arrow 164 indicating the belt pack controller 150 transmitting audio and/or data via an RF signal(s) to the ABS 110 and its input/output element 112. The transmissions 162 and 164 can be simultaneously transmitted over the full-duplex connection 160 (e.g., both the ABS 110 and the belt pack controller 150 can "speak" at the same time).

The belt pack controller 150 (which may have a unique ID as shown with RFID tag 154 to allow the host controller 180 to provide commands 182 to a desired belt pack controller 150 and associated costumed character) processes the cues or commands to select, retrieve, and then playback an audio clip pre-recorded and stored in memory in the belt pack controller 150. The audio or sound system 170 includes a speaker 172 mounted in the character/costume head 190, and the belt pack controller 150 functions to operate the speaker 172 via line(s) 171 to output audio content based on the audio clip identified in the command/cue 182 after its retrieval from data storage in the belt pack controller 150 (e.g., in an SD card or the like).

As shown, the network data connection 115 is also used to communicate status/heartbeat data from the costume assembly (or the character). To this end, the belt pack controller 150 may periodically operate to transmit status/heartbeat data in the RF transmissions/signals 164 that are received by I/O element 112 of the ABS 110 and transmitted as shown at 182 via Ethernet connection 114 to the host controller 180 for processing (e.g., to verify that the costume assembly and its components are still operable, still have battery life, and so on).

The audio system 170 further includes first and second (left and right) microphones 174 and 175 that are positioned in the costume head 190 and linked via line(s) 171 to the belt pack controller 150. The microphones 174, 175 may be positioned in the ears or other portions of the head 190 so as to be exposed at or be near an exposed surface so as to be able to sense or receive sound in the environment or space about the costume head 190. The microphones 174, 175 may listen to people or observers that are nearby to a performer wearing the costume assembly in the venue 104. This received sound or audio content is then provided to the performer wearing the costume head 190 and also transmitted with the audio portion of the RF transmissions 164 from the belt pack controller 150 over the full-duplex connection 160 to the ABS 110, where it is relayed by the ABS to the host controller 180 via line 117 connected to the audio output connection 118 as shown at 186.

The host controller 180 may process this sound or surveillance audio input (e.g., people's conversations) to select audio clips to playback over speaker 172 and, in response, transmit commands 182 via ABS 110 in the RF data transmissions 162 (e.g., a person nearby may say "Hello, Character's Name" and the host controller 180 may be operated to select a proper response such as "Well, Hello to you too, and welcome to the Venue's Name"). The microphones 174 and 175 may be provided in spaced apart locations such as relatively close to the wearer's left and right ears (e.g., on opposite sides of the head 190 such as in the ears of the head 190) such that the received sounds or environmental audio inputs provide location cues to the performer or person wearing the costume assembly. Specifically, this content from the left and right microphones 174, 175 is provided in the audio 186 input to the host controller 180 (via full-duplex connection 160 and signals 164), and the host controller 180 may provide audio communications 186 back to the costume assembly in venue 104 over line 117 and audio input connection 116 to the ABS 110 which relays the audio in RF transmissions 162 on the full-duplex connection 160 to the belt pack controller 150.

The belt pack controller 150 then provides this audio content to the left and right ear buds/phones 178, which are in, over, or near the performer's ears (e.g., ear buds worn in the performer's ears). The audio content received by the left microphone 174 is played back (or mixed into the content played) in the left ear bud/phone 178 and the content received by the right microphone 175 is likewise played back to the performer via the right ear bud/phone 178. In this way, even though the head 190 may make it difficult for a performer to hear sounds in the nearby environment, the audio 186 and 162 from the host controller 180 and ABS 110 acts to playback sounds to the performer over ear buds/phones 178 in a near real-time manner that allows the performer to detect where a sounds are originating from (where a person is standing relative to the performer in the venue 104). Hence, the performer can respond and turn to face the speaker and make gestures that are appropriate to the speaker and their dialog (e.g., recognize the speaker is a young person, is male or female, and so on).

The host controller or backstage system 180 may be operated to transmit additional audio content in the audio intercom communications 186 via the ABS 110 to the performer's ear buds 178 via belt pack controller 150 and the full-duplex connection 160. This additional audio content 186 is mixed with the surveillance audio content received by the host controller 180 from microphones 174, 175. The additional audio content 186 may include vocal instructions or cues from an operator of the host controller, and these instructions or cues may be associated with audio clips or animation actions selected for playback by the host controller 180. For example, the operator of the host controller (or the host controller in an automated manner) 180 may provide audio cues warning that a particular audio clip or piece of dialog will play soon or next (or that the face will be animated in a particular manner), e.g., "the cue or command for the Happy Birthday song will be triggered next" or "your special dance will start in 5 seconds" or "go greet the group speaking to you on your left" or the like.

The belt pack controller 150 is essentially a portable control system worn by an actor or performer (who also wears the head 190 with the audio or sound system 170). The belt pack controller 150 is the "brain" of the costume assembly and is responsible for control. At its core, there is software run by a processor(s) that may be labeled or considered a show playback engine, and this software acts as a media player for both the animation of components in the costume (such as in head 190) and for asynchronous playback of audio clips stored in the memory device(s) of the belt pack controller 150. For example, an SD memory card may be inserted into the controller 150, and the controller 150 may stream selected ones of the audio clips from the SD card to the speaker 172 (for a character's voice or whatever a recorded sound may be in an audio clip) when a cue/command is received in the transmission 162 from the host controller 180 via the ABS 110. The animation data may also be stored in the SD card and streamed by the controller's processor or "brains" to one or more motors in the belt pack 150 (or in the head 190) to cause motions such as movement of a mouth or eyes on/in the head 190.

Collectively, such command or triggering data 162 from the ABS 110 and host controller 180 can be referred to as a "cue" (e.g., a cue may trigger audio, animation, or both audio and animation). A cue is sometimes implemented as a pair of files (one audio file and one corresponding animation file). The audio files typically are relatively short phrases or sentences ("Welcome to the Party!" and the like). A cue name can be a number, and the audio and animation-initiating files stored in the memory of the belt pack controller may be named with that same number. When a cue is commanded by a host 180 and provided in full-duplex transmissions 162, the belt pack controller 150 determines the requested cue number and searches the memory (e.g., SD card or the like) for files named with (or retrievable based on) that number (or other file name). When one or more audio and/or animation files are found, the files are opened and played, e.g., audio and animation files played in sync (e.g., simultaneously) with each other. The end result is the visible and audible illusion that the costumed character is speaking.

The interactive controller 150 has a bidirectional wireless communications link 160 that performs at least one or more of the following functions: (1) receives control commands from the host system 180 via the ABS 110 as shown at 162; (2) sends status and acknowledgement data back to the host system 180 as shown at 164; and (3) provides a two way audio communications link for operators of the host system 180 and actors/performers wearing a walk-around costume and the interactive controller 150.

Character interaction with people in the venue 104 is enhanced by there being microphones 174, 175 on the costume (e.g., on/in head 190) that allow the operator of the host controller 180 to hear what these nearby people are saying. These microphone signals are transmitted from the walk-around costume as shown at 164 to the operator of the host controller 180 via the ABS 110 and wireless, full-duplex communications link 160. The operator of the host controller 180 can then cause the costumed character to respond to the nearby people (or "guests" of venue 104) by selecting a cue(s) from a plurality of audio and/or animation cues stored in memory of the belt controller 150. The host controller sends a command or instructions as data 162 over the communications link 160 to the belt pack controller 150 to command a cue (e.g., one or more of the audio and animation files in the memory of the controller 150) be played.

The actual components used to implement a belt pack controller 150 may vary to practice the system 100. However, in one exemplary cases, the controller 150 includes an audio main board that had a footprint of 2.85 by 2.80 inches, had a 7-26 VDC power supply, and had a current draw of 40-60 mA @ 24 V (no peripherals or speaker) fused at 1.5 A. A processor was provided for running the control software (as discussed above) in the form of an STM32F407 ARM 32-bit Cortex-M4 processor with a FPU, a 1 MByte flash, 168 MHz speed, and a 16 MB external SRAM. Peripherals that were included were a high speed USB OTG 2.0, a 10 MBaud RS422, a 10 MBaud RS485, a CAN bus 2.0, a 10 digital I/O, a micro SD card, a 24 bit audio CODEC (two channels in, two channels out, and patchable), and a 40 W Class D audio amplifier. The stacked board connections were 5 VDC, 3.3 VDC, all CODEC audio lines, 12C bus, SPI bus, 8 processor digital I/O, 3 processor A/D inputs, 1 processor encoder interface, 10 external DB44 lines, and a 3.5 mm jack connections. External connectors included a DB44 connector (power input, 5 V output, RS485, RS422, CAN bus, and 10 processor I/O lines), a Turck 5-pin female receptacle connector (audio amplifier output (speaker) and two microphone inputs (reconfigurable)), a 3.5 mm jack (stereo audio output (reconfigurable)), a 2.5 mm jack (stereo audio input (reconfigurable)), a USB connector (mini USB connector and 5-pin 2 mm header), and an SD card (micro SD socket).

Wireless communication module/element 152 may also be implemented in several ways to achieve the full-duplex link 160 with the ABS 110. In one case, though, it was implemented using a wireless communication stacked board. This board includes an A8520 Anaren integrated radio transceiver (with a TI Purepath wireless network chipset with 2.4 GHz adaptive frequency hopping, a bidirectional 16-bit streaming audio for communication, and a bidirectional 100 kbps data channel for system control), an audio CODEC (with a headphone driver output, 3 configurable analog audio inputs, 4 configurable line level outputs, and an Anaren module digital audio interface), two microphone preamps (e.g., for Shure WL93/SM93 microphones as shown at 174, 175).

The ABS 110 may take a number of forms to provide its desired functions. In one implementation, the ABS 110 has a footprint of a 19-inch 1U rack mount with a 12 VDC power supply. Its processor was chosen to be a Motorola Coldfire MCF52235 running Freescale's MQX OS, and the ABS 110 has connections 114, 116, and 118 in the form of a 10/100 Ethernet port and unbalanced line level audio in and out. The wireless communications element 112 includes an A8520 Anaren integrated radio transceiver (e.g., with a Purepath wireless network chipset with 2.4 GHz adaptive frequency hopping, bidirectional 16 bit streaming audio for communication, and bidirectional 100 kbps data channel for system control).

The ABS 110 serves as the wireless bridge for host 180 communication and control of the interactive character head beltpack 150. This allows the performer wearing the walk-around costume (including beltpack 150 and head 190) to operate without the need for physical wire connections to the host system 180. The base station 110 is essentially transparent to the operation of the system 100 and provides at least one or more of the following: (1) connection control; (2) function control of the beltpack 150 from the host controller 180; (3) feedback 164 from the beltpack 150; and (4) audio communication between operator of the host controller 180 and the performer wearing the beltpack 150 (as shown at 162 and 164 over full-duplex communications connection 160 and at 182, 186 between the ABS 110 and host controller 180).

In an exemplary implementation, the ABS 110 utilizes an A8520 Anaren radio module to achieve wireless functionality. This module has two audio transport channels as well as a bidirectional data channel. The Anaren radio module uses the Texas Instrument's CC85xx family of 2.4 GHz short range adaptive frequency hopping integrated digital audio transceiver chips. These devices implement the PurePath wireless audio network for connectivity, which utilizes a star topology formed by a protocol "master" (e.g., beltpack 150) and one or more protocol "slaves" (e.g., ABS 110). In the MWWM application, the topology is always 1:1 (one master to one slave in each network). Four LED indicators on the front panel of the ABS 110 display the status of power, connection with the belt pack controller 150, and Ethernet link via connector 114 and line 115 with the host controller 180.

Each device has a unique factory set ID similar to a MAC address on a computer. The implementation of the network and unique IDs allows multiple hosts and beltpacks to operate in parallel and in close proximity to one another. The ID of each beltpack in the system is known by the host controller. The host controller establishes a connection to a beltpack by sending the base station a "connect" command with the ID of the desired beltpack. The base station ("slave") module transmits a pairing signal indicating its desire to connect with that particular master (beltpack) module. If that beltpack is in range and available to join the network, a connection will be established (e.g., a full-duplex communications link 160), and the base station will send a connection response to inform the host controller of a successful connection. Once a connection is established, the system transparently monitors and maintains the connection until the host controller sends a "disconnect" command.

The Anaren radio module provides a bi-directional data path that is established and maintained along with the audio channels. This data channel is used by the base station to forward commands from the host controller to the belt pack controller and to receive data back from the belt pack controller for return to the host controller. The host controller controls the operation of the belt pack controllers through control commands (e.g., UDP commands, TCP/IP commands, JSON-formatted control commands, or the like) sent to the base station via Ethernet UDP or other messages. The base station parses, decodes, reformats, and sends these commands to the belt pack controller (as shown at 162 in FIG. 1). It then sends responses either from the belt pack controller or itself back to the host controller such as the status and success of commands, system data, messages, and errors. In some cases, two RCA connectors or the like on the back of the base station housing provide line level audio connections for an operator headset and microphone. The "line out" connection (e.g., connector 118 in FIG. 1) provides a mono feed from the surveillance microphones on the costume (e.g., left and right microphones 174, 175 provided in or near the ears of the character head 190), and the "line in" connection (e.g., connector 116 in FIG. 1) provides an input for audio to the in-ear headset provided in the sound system of the costume assembly (e.g., ear buds 178 of sound system 170 at least partially mounted in or on the character head 190).

Figure 2:
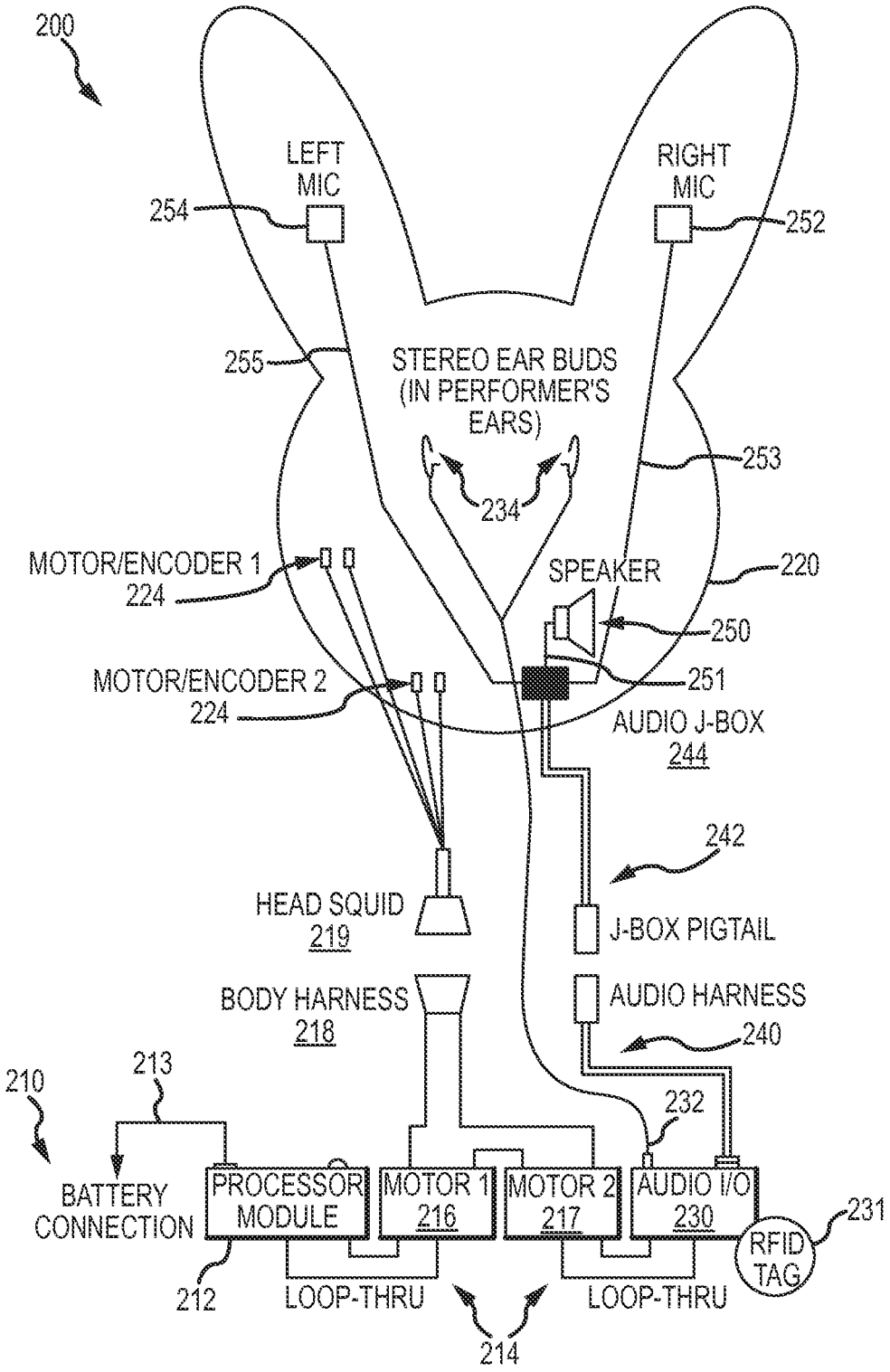
FIG. 2 is a functional block diagram or schematic drawing of the costume assembly (or performer-wearable portion of a control system as may be used in the control system of FIG. 1)

FIG. 2 illustrates an exemplary costume assembly 200, as may be used in the system 100 of FIG. 1, in more detail. The costume assembly 200 includes a belt pack or interactive controller 210 that includes a processor (or "brains") module 212 that includes memory and software (e.g., a show control engine) that is managed and/or run (executed) by one or more processors in the module 212 to provide the interactive playback and communications functions described herein. A battery connection 213 is provided to allow a portable battery (not shown) to be used and worn to power the processor module 212 and other components of the assembly 200 via a loop-through 214 or similar power and communications connection(s).

The belt pack controller 210 further includes motor drivers or motor drives 216, 217 that are selectively controlled by the processor module 212 such as by playing an animation file or cue (in sync with an audio file or alone) when commanded by a host controller via an ABS (as shown in FIG. 1). The motors 216, 217 are linked via a body harness 218 and head squid 219 to motors/encoders 224 on the costume such as in a character head 220, and the motors/encoders 224 function to provide motion to one or more features of the costume 220, e.g., to move a mouth, to move eyes and/or eyebrows, to wiggle ears, and the like.

The belt pack controller 210 also includes an audio input/output (I/O) module 230, with an RFID tag 231 that identifies it to a host controller, and the audio I/O 230 is adapted to provide a full-duplex, wireless communications link with a host controller via an ABS as discussed with reference to the system 100 of FIG. 1. The processor module 212 further selectively operates the audio I/O module 230 to playback audio files in response to receiving a command or cue from a host controller, and, again, these files may be asynchronously chosen from a plurality of audio files or clips stored in memory of the processor module 212 and, when desired, played in a synchronized manner with animation files used to operate the motors 216, 217. The audio I/O module 230 is linked via audio harness 240, J-box pigtail 242, and audio junction box 244, and wiring 251 with a speaker 250 positioned in/on the costume 220 (e.g., near a mouth of a character head as shown in FIG. 2). In practice, the audio I/O module 230 is controlled by the processor module 212 to play an audio file (e.g., a clip of character dialog or other pre-recorded sounds) and the audio I/O module 230 outputs the corresponding audio via the speaker 250 (e.g., to cause the character to "speak" in an interactive manner with a nearby person).

The costume assembly 200 further includes a pair of stereo ear buds 234 that a person wearing the costume 220 may insert into (or wear over in the case of ear phones being used in place of buds) their ears. The audio I/O 230 receives audio transmissions from a host controller via an ABS as discussed with reference to FIG. 1, and this received audio is output via the wire(s) 232 in the ear buds 234 such that the performer/costume wearer can listen. Particularly, the costume assembly 200 also includes right and left microphones 252, 254 that operate to detect or sense sounds in the space or environment near to the costume 220 and to provide these sounds to the audio I/O module 230 via connecting wires 253, 255. The audio I/O module 230 relays these environmental sounds to a host controller via the full-duplex, wireless connection to an ABS, and the host controller provides these sounds back to the audio I/O module 230 for playback in the right and left ear buds 234.

The host controller may play back the sounds (e.g., in the right ear bud with sound from the right microphone 252 and in the left ear bud with sound from the left microphone 254 to provide accurate playback of what sounds were heard and with which microphone (with the microphones often being spaced apart and located in the costume on left and right sides of the costume 220)). In other cases, though, the host controller may also provide vocal communications from a human host or an automated/electronic host, and these communications are mixed in with the sounds received by the microphones 252, 254. For example, an operator of the host controller may speak into a microphone at the host controller to let the performer know that a particular cue is about to be commanded to allow them to be prepared to move in the costume in a way that suits the audio and/or animation files to be played by the belt pack controller 210.

Figure 3:
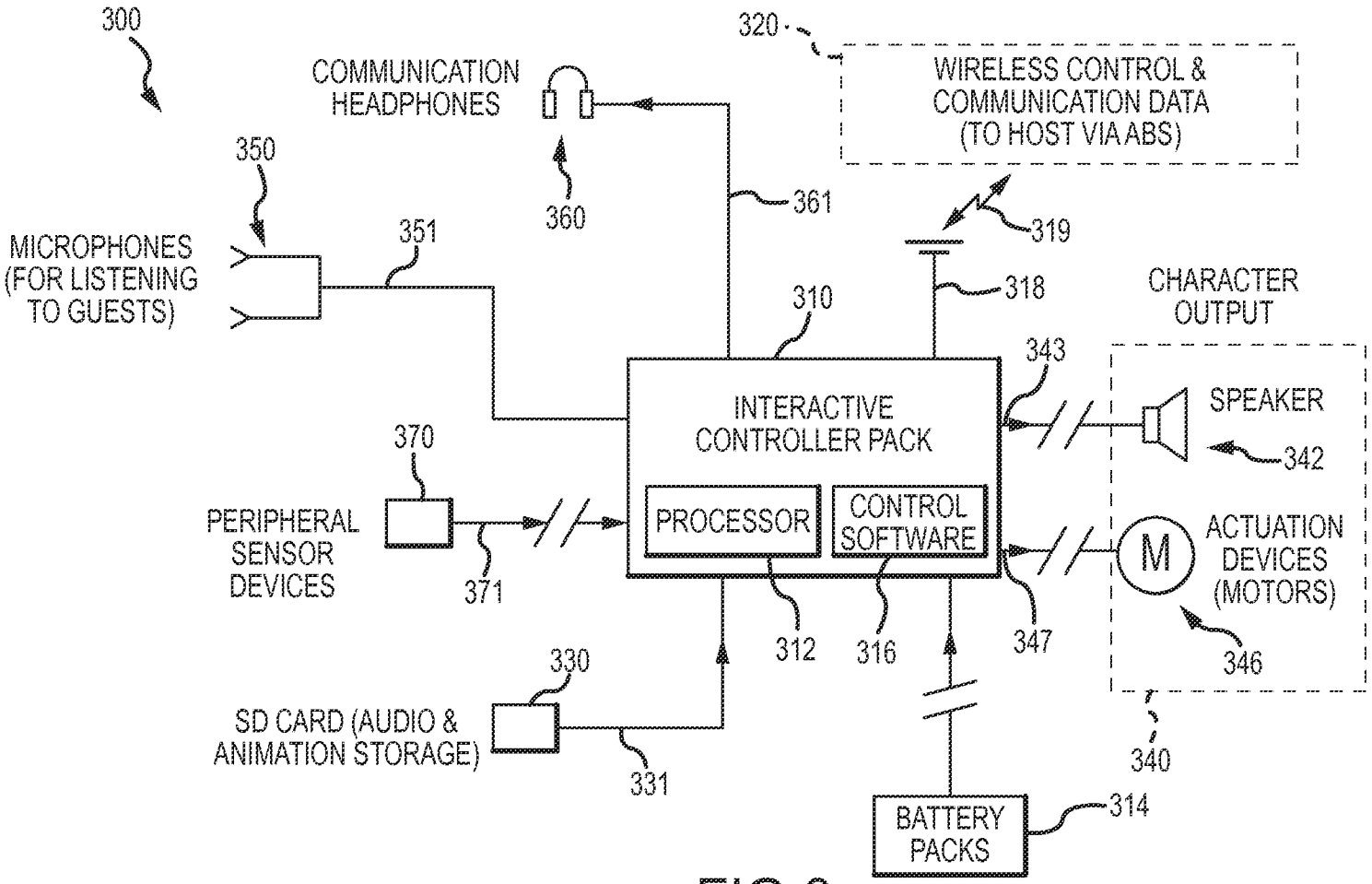
FIG. 3 is schematic or functional block diagram of another implementation of a costume assembly (or performer-worn portion of a control system) similar to that shown in FIG. 2 but providing additional or different details.

FIG. 3 illustrates a functional block diagram of another implementation of a costume assembly 300 that may implement an interactive control system such as the system 100 shown in FIG. 1. The assembly 300 includes an interactive controller pack 310 that may be worn by a performer wearing a walk-around costume. The interactive controller pack 310 includes a processor (or CPU) 312 that executes code or software in computer readable medium in the pack 310 (e.g., code stored in local memory) as shown as control software 316, and the control software 316 is configured to provide the show control engine and functionality described herein. A battery pack(s) 314 may be connected to or inserted into the controller pack 310 to power the processor 312 and other components of the assembly 300 requiring electrical power to operate.

The costume assembly 300 includes a wireless communications element 318 to provide a full-duplex, wireless communication link 319 with a host controller/backstage system (not shown in FIG. 3 but shown in FIG. 1), and the control software 316 acts to transmit and receive wireless control and communication data 320 to and from the host controller. This data 320 may include commands or cues to playback audio and/or animation files, which are pre-recorded and stored in memory devices such as an SD card 330 inserted into or linked as shown at 331 with the controller pack 310. The controller pack 310 processes the control data 320 to select these audio and animation files and then operates via links 343, 347 an audio speaker 342 and/or actuation devices 346 provided as part of a character output assembly 340 of the costume assembly 300 (e.g., one or more speakers near a character's mouth and motors at or near movable features of a costume such as eyes and a mouth).

The costume assembly 300 further includes microphones 350 for listening to nearby sounds including people in the vicinity of the costume assembly 300 (and performer wearing the assembly 300). The sounds detected or sensed by these microphones are provided to the controller pack 310 via connecting line 351 and then relayed by the control software 316 and wireless communication element 318 and full-duplex communications link 319 to the host controller (as shown at 320). The host controller provides this audio content (as shown at 310 in full-duplex mode over connection 319) for playback by the controller pack 310 and its software 316. The costume assembly 300 also includes communication headphones 360 that may be worn by a performer wearing the costume assembly 300 and an associated costume (e.g., a character head). Again, this audio content may be provided "as is" (e.g., in an earphone associated with one or more of the microphones such as left-mounted microphone used to feed sound to a left headphone and so on) or with mixing with communications from a host controller (automated "vocal" conversations) or an operator of the host controller (e.g., spoken communications from an operator to assist the performer with interacting effectively with nearby people and so on). The assembly 300 may further include one or more peripheral sensor devices 370 providing data about the local environment or operation of the costume assembly 300 via link 371 to the controller pack 310 for action by the control software 316 or for relay to a host controller via link 319 in data 320.

Figure 4:
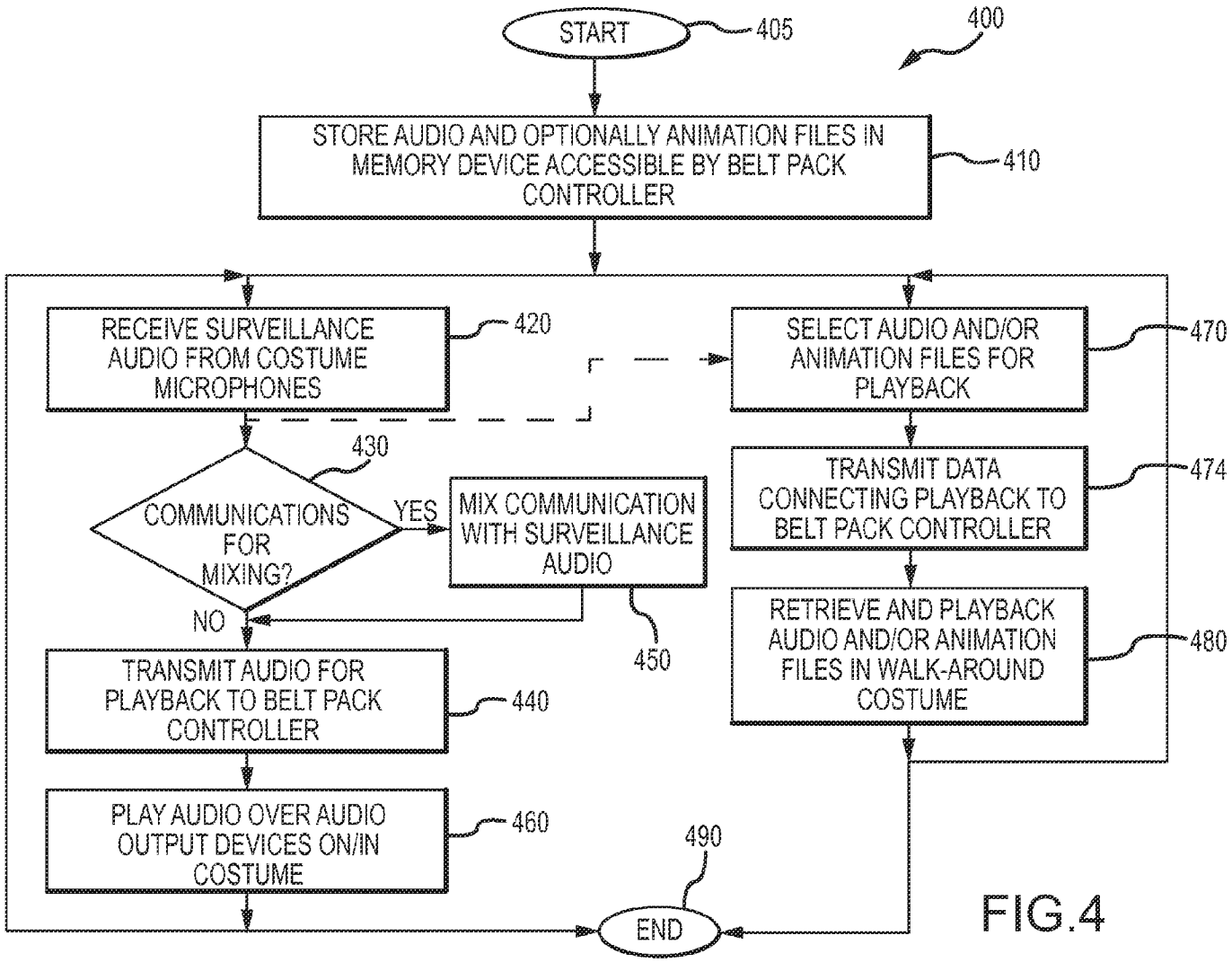
FIG. 4 is a flow diagram showing a method for controlling and/or operating a costume assembly worn by a performer with a walk-around costume (e.g., a costume with a character head that can be activated to speak and/or interact with nearby people or "guests" or "visitors" of a venue).

FIG. 4 illustrates a flow diagram of a control method 400 for operating and controlling a costume assembly worn by a performer also wearing a walk-around costume (e.g., one with a character head that may or may not be articulable). The method 400 starts at 405 such as with assembling a costume assembly as shown in FIGS. 2 and 3 for use in a control system as shown in FIG. 1. This may include providing communication devices adapted for providing a full-duplex, wireless communications with an ABS and providing a speaker for audio output, microphones for sensing sounds nearby the costume, and audio output devices for allowing the wearer (performer) of the costume to be fed sounds from the microphones and/or communications from an operator of a host controller (or directly from the host controller in a more automated implementation).

The method 400 continues at 410 with storing audio and (optionally) animation files in one or more memory devices that are then made accessible by the belt pack controller. The method 400 then continues along two concurrently performed paths. One path starts at 420 with receiving surveillance audio content from the costume microphones. At 430, the method 400 then continues with determining (e.g., by the host controller) whether there exists communications for mixing with this received/sensed surveillance (or environmental) audio content. If yes, the method 400 continues at 450 with mixing the communications (such as from a microphone at the host controller spoken into by an operator) with the audio content. Then (or if no at 430), the method 400 continues at 440 with transmitting, via the ABS over the full-duplex communications link, the audio for playback to the belt pack controller. At 460, the belt pack controller receives this audio content and plays it back over the audio output devices on or in the costume, e.g., over ear buds, headphones, or the like to the performer's ears.

A second concurrently performed path starts at 470 with selecting audio and/or animation files for playback by the costume assembly. This selection may be performed by the host controller and/or an operator of the host controller, and this choice may be based on the received surveillance audio (e.g., is a nearby guest saying "hello" or "it's my birthday" and so on). Once chosen, commands and/or data are transmitted over at 474 over the full-duplex, wireless communication link to the belt pack controller. The belt pack controller then retrieves the cued or commanded audio and/or animation files from a local or accessible memory device (see step 410) and operates local components to playback the retrieved files, e.g., plays audio over a local speaker and operates animation motor to move one or more features of the costumes (e.g., move the character's eyes or mouth or the like). The method 400 then may continue with more interactive controls at 420 and/or 470 or the method 400 may then end at 490 (when an interactive session is completed and/or the performer takes the costume off).

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

One skilled in the arts will readily be able to identify a number of useful advantages that are provided by the control systems and methods described herein. These advantages include: (a) providing a self-contained device (e.g., the costume assembly) that integrates a plurality of devices and functions into one package, e.g., an integration of a processor, data and audio amplifiers, audio inputs and outputs, an RF module, and storage media; (b) the costume assembly including the belt pack controller and sound system/components is extremely small and concealable, which is suitable for use within or as part of a wearable walk-around costume; (c) the belt pack controller is a modular device, which allows it to be used with existing articulated and non-articulated character heads and their existing audio systems so as to make these heads useful for interacting with observers or visitors; (d) the components of the control system are non-costume or application specific, which allows for many creative possibilities and uses; (e) the costume assembly through its integration of functions generally uses less power than would a number of discrete or non-integrated devices that were adapted to perform the same functions separately; (f) provides ability to use RF connection for bi-directional audio and data transmissions; (g) provides ability for data connection to be used for commands and for monitoring/feedback/fault status; (h) provides ability to add peripheral sensors to sensor bus (e.g., an RS-485 sensor bus), with these sensors then being used to trigger cues; (i) provides ability to add pair a wireless belt pack controller with an audio base station for multi-characters and/or multi-rooms that may be adjacent or near to each other; and (j) each costume assembly or belt pack controller may have a unique ID (e.g., a factory set ID similar to a MAC address on a computer), and the implementation of a wireless network and unique IDs allow multiple host controllers and belt pack controllers to operate in parallel and in close proximity to one another (note that the ID can alternatively be programmed onto an RFID tag that is physically attached to the belt pack controller for flexible multi-character and multi-room installations).

Due to the "transparent" nature of the audio base station (ABS), an external host controller can be used for a plurality of interactive applications. To accomplish the feature set of the control system described herein, one would have to combine the functionality of several disparate devices and still likely would not produce the inventors' control system. If combinations were attempted, the assembly would be bulky, unreliable in its communications and/or operations, and unsuited for concealment within a character costume. Further, the plurality of wireless devices would have to be configured to co-exist without interfering with each other, which may prove difficult in practice. Additionally, without the control system as taught by the inventors, audio devices such as smartphones or a portable media player likely would be difficult if not impossible to operate or trigger from an external transceiver and for selective, asynchronous playback.

We claim:

1. A control system for selectively operating a sound system provided in a walk-around character costume, comprising:

an interactive controller adapted for a performer to wear;

an audio base station spaced apart from the interactive controller; and a host controller communicatively linked to the audio base station, wherein the interactive controller and the audio base station each includes a wireless communication element operable to provide a full-duplex communications link between the interactive controller and the audio base station, further comprising a speaker controlled by the interactive controller, wherein the host controller transmits data over the full-duplex communications link via the audio base station including commands to play an audio file, stored in memory accessible by the interactive controller, with the speaker, and further comprising a microphone linked to the interactive controller, wherein the microphone captures sounds proximate to the walk-around character costume and wherein the interactive controller transmits the captured sounds over the full-duplex communications link to the host controller via the audio base station.

2. The control system of claim 1, wherein the audio file is selected based on the captured sounds.

3. The control system of claim 1, further comprising an audio output device operating to output audio perceptible by the performer and wherein the host controller generates additional audio content and mixes the additional audio content with the captured sounds and transmits the mixed additional audio content and the captured sounds to the interactive controller over the full-duplex communications link for playback with the audio output device.

4. The control system of claim 3, wherein the additional audio content is vocal communications from an operator of the host controller.

5. The control system of claim 1, further comprising costume animation mechanisms controlled by the interactive controller and wherein the host controller transmits data over the full-duplex communications link via the audio base station including commands to play an animation file, stored in memory accessible by the interactive controller, to selectively operate the animation mechanisms.

6. A wearable audio assembly, comprising:

a wearable controller adapt for full-duplex communications with a remote host controller;

data storage storing a plurality of audio files;

a speaker operable by the wearable controller, in response to receiving commands from the remote host controller via the full-duplex communications, to asynchronously play one or more of the audio files;

performer-wearable audio output devices operable by the wearable controller to play audio content received from the remote host controller via the full-duplex communications, wherein the audio content includes vocal content from the remote host controller; and a pair of microphones linked to the wearable controller, wherein the microphones receive sound from an environment about the wearable controller.

7. The assembly of claim 6, wherein the received sound is transmitted by the wearable controller to the remote host controller.

8. The assembly of claim 6, wherein the audio content includes the vocal content mixed with the received sound.

9. The assembly of claim 6, further comprising costume animation mechanisms operable by the belt pack controller using animation files stored in the data storage that are cued by commands from the remote host controller via the full-duplex communications.

10. The assembly of claim 6, further including an audio base station configured to provide the full-duplex communications between the wearable controller and the remote host controller.

11. The assembly of claim 10, wherein the audio base station has an Ethernet connection with the remote host controller and audio input and output connections with the remote host controller.

12. A method for controlling operation of output components of a walk-around character costume adapted for wearing by a performer, comprising:

storing a plurality of audio files in memory;

establishing a bidirectional communications link between a performer-wearable controller and an audio base station that is linked to a host controller;

transmitting audio transmissions over the bidirectional communications link from the performer-wearable controller to the host controller via the audio base station; and concurrently with the audio transmissions transmitting, transmitting data including a command to play one of the audio files, on a speaker, over the bidirectional communications link from the host controller via the audio base station to the performer-wearable controller, wherein the audio transmissions include audio content gathered by microphones mounted on or in the walk-around character costume.

13. The method of claim 12, further comprising transmitting audio transmissions from the host controller to the performer-wearable controller over the bidirectional communications link and outputting the audio transmissions via a sound output mechanism to a perform wearing the walk-around character costume, wherein the audio transmissions include the gathered audio content.

14. The method of claim 13, wherein the audio transmissions further comprise vocal communications mixed with the gathered audio content.

15. The method of claim 12, wherein the transmitted data includes a command to play an animation file concurrently with the one of the audio files.

* * * * *